United States Patent [19]

Shih et al.

[11] 4,305,812

[45] Dec. 15, 1981

[54] SOLVENT DEASPHALTING BY POLARITY GRADIENT EXTRACTION

[75] Inventors: Stuart S. Shih, Cherry Hill; Samuel A. Tabak, Wenonah; Philip J. Angevine, West Deptford; Michael B. Carroll, Mantua, all of N.J.

[73] Assignee: Mobil Oil Corporation, New York, N.Y.

[21] Appl. No.: 160,876

[22] Filed: Jun. 19, 1980

[51] Int. Cl.[3] ..... C10C 3/00

[52] U.S. Cl. ..... 208/309; 208/311; 208/320

[58] Field of Search ..... 208/45, 86, 309, 311, 208/320

[56] References Cited

U.S. PATENT DOCUMENTS

| | | | |
|---|---|---|---|
| 2,980,602 | 4/1961 | Garwin | 208/309 |
| 3,433,735 | 3/1969 | Broughton | 208/311 |
| 3,779,896 | 12/1973 | Woodle | 208/309 |

*Primary Examiner*—Brian E. Hearn

*Attorney, Agent, or Firm*—Charles A. Huggett; Michael G. Gilman; Claude E. Setliff

[57] ABSTRACT

An improved method for deasphalting residua or heavy oils comprises the use of at least two solvents in an extraction column to establish a liquid polarity gradient within it.

22 Claims, No Drawings

SOLVENT DEASPHALTING BY POLARITY GRADIENT EXTRACTION

BACKGROUND OF THE INVENTION

1. Field of the Invention

The invention relates to extraction to separate asphaltenic and maltenic material from residua and heavy oils. More particularly, it concerns the use of two or more solvents of differing polarity to effect such extraction.

2. Discussion of the Prior Art

Solvent deasphalting is a well-known operation in refineries. The primary objective of deasphalting is to separate a petroleum stream into a relatively high quality fraction ("deasphalted oil" or "maltenes") and a lower quality fraction ("asphalt" or "asphaltenes"). The asphaltenes are generally higher in aromaticity, Conradson Carbon Residue (CCR), molecular weight, and heteroatom (S, N, Ni, V, Fe, etc.) content. Conversely, the maltenes are generally lower in these. Solvent deasphalting may also be thought of as a simple form of compositional delineation. Many methods have been used in the past, and many are currently available for separating hydrocarbons into their more distinct compositional groups. One available method is gradient elution chromatography. Another method is deasphalting with liquid propane.

SUMMARY OF THE INVENTION

In accordance with the invention, there is provided an improved method for solvent deasphalting a residua heavy oil coal liquid, or other low quality hydrocarbon by contacting said hydrocarbon with solvent in a countercurrent extraction column, the improvement wherein at least two polar solvents contact the residua or heavy hydrocarbon, the least polar solvent being injected into the column end nearest the the raffinate take-off stream point and the most polar being injected into the column nearest the extract take-off stream point.

DESCRIPTION OF SPECIFIC EMBODIMENTS

Polarity gradient extraction (PGE) operates by injecting two or more solvents into different parts of a liquid phase extraction column. The most polar solvent, with reference to less polar solvents, is injected near the bottom of the column and the least polar near the top. Liquid is drawn off both bottom and top of the column. This results in a concentration gradient of the several solvents within the column. This concentration gradient in turn effects a solvent polarity gradient, it being least polar at the top of the column and most polar at the bottom thereof. The solvent concentration gradient may be achieved by relative solvent feed rates and/or extraction column configuration and/or solvent injection port location. Resid or other heavy hydrocarbon, with or without a cutter solvent, is injected into the top portion of the column. As the residuum ('resid') enters the least polar part of the column, a maltenic fraction dissolves, whereas the more dense asphaltenic fraction precipitates down the column. As the asphaltenic fraction enters a more polar zone it tends to lose its maltenic components and concentrate in its refractory components.

The net effect is to produce an overhead raffinate stream enriched with low CCR maltenic material, which may be tapped from a take-off line near the top of the column, and a bottoms enriched with high CCR asphaltenic material which may be removed from a take-off line near the bottom of the column. Overhead and bottoms solvents are removed by flash distillation, and the solvents are then purified by distillation and recycled.

If desired, side draw streams may be taken at any point in the column. In addition, for cases where the bottoms stream contains precipitate, a settler may be used to further cut the bottom fraction.

In this invention, the solvent polarity gradient in the extractor is established by the composition gradient of the solvent and/or temperature gradient in the extractor. This solvent polarity gradient provides the ability of continuous extraction and flexibility to control the quality of extract from the top of the extractor.

In connection with the above discussion, it should be recognized that the solvents may be injected at any number of points along the extraction column as long as the order of such injection, from bottom to top of the column, is the most polar to the least polar solvents. For example, where at least three solvents are used, they will be injected into the column in the order of polarity so that the solvents of intermediate polarity will enter the column at points intermediate to the entry points of the high and low polarity solvents.

In accordance with one embodiment of solvent extraction as it is presently practiced, a lube oil crude fraction of hydrocarbon feedstock boiling above 550° F. is contacted with solvent such as furfural, in an extraction column under conditions of temperature and solvent concentration to remove the maximum amounts of raffinate and extract. However, present practices, which have been optimized for the lighter feedstocks, do not afford satisfactory yields of extract when the heavy oils are extracted. These heavier feedstocks have increased quantities of high CCR and hard-to-process vacuum residua. Polarity gradient extraction allows the residua to be sharply cut to give maximum yield of a low CCR maltenic fraction suitable for catalytic cracking. However, although the method was developed to overcome prior art inadequacies with respect to heavy oil extraction and although such heavy oils are the preferred feedstock for practicing this invention, the method will work for the lighter oils in general use today.

The hydrocarbon oil contemplated comprises a residual hydrocarbon boiling above 650° F. The oil includes petroleum residua, coal-derived liquids, tar sands-derived liquids, shale oils and biomass-derived liquids.

The solvent system used in this invention consists of at least two solvents, which are introduced into the extractor at different locations. Solvent concentration gradient can be maintained by minimizing backmixing, achieved by maintaining a column height-to-diameter (H/D) of at least 10. Backmixing can also be minimized by designing the internal portion of the extraction column to utilize baffles and/or contacting devices. The selection of the solvents is based on the polarity, or on the polarity index thereof. The dielectric constant of the solvent can be used as a guideline for the solvent polarity. Additionally, polarity index can be arbitrarily defined as extraction yield of a mixture of model compounds (Table 1). For example, pyridine is more polar than propane, because pyridine has a higher dielectric constant (12.3 vs. 1.66 at 25° C.). The selection of the solvent system is dependent on the feedstock properties and operating conditions. However, the solvent system selected should satisfy the range of separation coefficient "K" defined below. In polarity gradient extraction the choice of solvents is governed by their ability, relative to each other, to partition the heteroatom and CCR of the hydrocarbonaceous material to be extracted. For each solvent (or solvent mixture of fixed composition) at a given temperature, pressure, and oil/solvent ratio a separation coefficient "K" exists:

$$K=p/e$$

where:

p=mass fraction as precipitate e=mass fraction as extract.

To have polarity gradient extraction the ratio: "K Top of Column/K Bottom of column" must be greater than 1 with preferred operation greater than 5. For the limiting case of no precipitate at column bottom, this ratio goes to infinity. In one embodiment, the highest polarity solvent is sufficiently polar to dissolve the extract phase product, permitting all product take-off streams to be in the liquid phase.

The required solvent-to-hydrocarbon feed ratio is dependent upon the feedstock properties and will, in general, increase with increasing feed heterogeneity. The operating range of this ratio is about 0.1 to 100 (volume of solvent/volume of feed), generally, and about 1 to 20, preferably.

Similarly, the required residence time is dependent upon the feedstock properties. For example, a solid feed requires a relatively long residence time to be effectively treated. Conversely, a highly polar liquid feed in a very low polarity solvent requires a relatively short residence time. Required residence times can be reduced by the use of mechanical contacting devices. Space velocities (LHSV) defined as volume of oil/hr-/volume of extraction column) range from about 0.1 to 10 $hr^{-1}$, generally, and about 0.2 to 5, preferably.

For optimum separation of the solvents from the feedstocks, the solvents should boil at least 100° F. below the initial boiling point of the feedstock to permit easy separation thereof, as by a vapor-liquid flash separation. Further the boiling points of one solvent should differ by at least 50° F. from the other solvent or solvents so separation can be obtained in, for example, a vapor-liquid flash vessel. Still further, in one embodiment of the invention, the column temperature and pressure are controlled such that at least one of the solvents exists as a supercritical fluid.

Operating pressures range from about 0 to 2000 psig, generally and about 0 to 500 psig, preferably. Pressures should be high enough for all solvents which have critical temperatures above the operating temperature to be primarily in the liquid phase.

Polarity index (PI), as used hereinabove, is defined as the extraction yield of a mixture of model compounds, normalized to an arbitrary solvent of high polarity, as for example, pyridine, as 100. An example of a mixture of model compounds is shown in Table 1.

TABLE 1

| Composition of Mixture Suitable For Measuring Polarity Index | Wt % |
|---|---|
| Mesitylene | 50.0 |
| Phenanthrene | 10.0 |
| Benzothiophene | 10.0 |
| α - Naphthol | 10.0 |
| β - Cresol | 10.0 |
| Dibenzofuran | 10.0 |

Having discussed the invention in broad terms, the following will specifically illustrate it. It will be understood that the example is illustrative only, and is not intended to limit the invention.

EXAMPLE 1

To demonstrate the effect of solvent polarity a series of solvents was evaluated by extracting an Arabian Light atmospheric resid having the properties shown in Table 2.

TABLE 2

| | |
|---|---|
| Gravity, °ApI | 19.8 |
| Hydrogen, Wt % | 11.97 |
| Sulfur, Wt % | 2.77 |
| Nitrogen, Wt % | 0.16 |
| CCR, Wt % | 6.11 |
| Nickel, ppm | 7 |
| Vanadium, ppm | 21 |
| Asphaltenes | 5.05 |
| Distillations (ASTM D-2887)°F. | |
| IBP | 338 |
| 10% | 559 |
| 20% | 646 |
| 30% | 716 |
| 40% | 790 |
| 50% | 877 |
| 60% | 965 |
| 70% | — |

The solvents tested are shown in Table 3 along with extract yield and heteroatom analyses. As the table shows, the extract yield is strongly dependent on the type of solvent used, ranging from 12% for less polar dimethyl formamide to 100% for very polar pyridine. Heteroatoms and metals are significantly reduced in the extracts for some solvents. The dielectric constant is often used as an approximate measure of polarity. The dielectric constants for some solvents are given in Table 3.

TABLE 3

EXTRACTION OF ARABIAN LT. ATMOSPHERIC RESID

| Solvent | | Extract* | | | | |
|---|---|---|---|---|---|---|
| Name | Dielectric Constant | Yields | S | N | Ni | V |
| | | Wt % | Wt % | Wt % | ppm | ppm |
| Dimethylformamide (DMF) | — | 12 | 2.3 | — | 3.1 | 19 |
| Pentane/DMF 50/50 blend | — | 44 | 1.15 | — | — | — |
| Pentane | 2.1 (20° C.) | 89 | 2.62 | 0.07 | 1.8 | 6.1 |
| Heptane/DMF | — | 94 | 2.5 | — | 2.1 | 7.5 |
| Glacial acetic acid/HCL | — | 80 | 2.27 | — | 6.8 | 20 |
| Phenol | 9.78(60° C.) | 95 | 2.31 | 0.08 | — | — |
| Pyridine | 12.3(60° C.) | 100 | 2.77 | 0.16 | 7 | 21 |

TABLE 3-continued

| EXTRACTION OF ARABIAN LT. ATMOSPHERIC RESID | | | | | | |
|---|---|---|---|---|---|---|
| Solvent | | | | | | |
| Name | Dielectric Constant | Extract* Yields | S | N | Ni | V |
| Toluene | 2.38(25° C.) | 100 | 2.77 | 0.16 | 7 | 21 |

Note:
The resid was extracted with the solvent (1:4 ratio) at room temperature. The data are based on a solvent-free basis.

We claim:

1. An improved method for deasphalting a feedstock in an extraction column by contacting said feedstock with solvent under conditions to produce a raffinate and an extract phase, the improvement wherein said feedstock is contacted with at least two polar solvents, the least polar of which is injected into said column at a point nearest the column end nearest the raffinate take-off stream point and the most polar of which is injected into said column at a point nearest the column end with the extract take-off stream point.

2. The process of claim 1 wherein at least three solvents are used and wherein the solvents are injected into the column in the order of their polarity, the medium polar solvents being injected at points intermediate to the low polar solvent injection port and to the high polar solvent injection port.

3. The process of claim 1 wherein the raffinate take-off line is near the top of the column and the extract take-off line is near the bottom of the column, resulting in gravity settling to effect product separation.

4. The process of claim 2 wherein the raffinate take-off line is near the top of the column and the extract take-off line is near the bottom of the column, resulting in gravity settling to effect product separation.

5. The process of claim 1 wherein the solvent concentration gradient is maintained by minimizing backmixing through the use of a column height-to-diameter ratio of at least 10.

6. The process of claim 2 wherein the solvent concentration gradient is maintained by minimizing backmixing through the use of a column height-to-diameter ratio of at least 10.

7. The process of claim 1 wherein the highest polarity solvent is sufficiently polar to dissolve the extract phase product.

8. The process of claim 2 wherein the highest polarity solvent is sufficiently polar to dissolve the extract phase product.

9. The process of claim 1 wherein the solvents boil at least 100° below the initial boiling point of the feedstock.

10. The process of claim 2 wherein the solvents boil at least 100° below the initial boiling point of the feedstock.

11. The process of claim 1 wherein a solvent polarity gradient is controlled by one or both of solvent type and relative solvent concentration.

12. The process of claim 2 wherein a solvent polarity gradient is controlled by one or both of solvent type and relative solvent concentration.

13. The process according to claim 1 wherein solvent concentration gradient is achieved by one or more of relative solvent feed rates, extraction column-configuration and solvent injection port location.

14. The process of claim 2 wherein solvent concentration gradient is achieved by one or more of relative solvent feed rates, extraction column-configuration and solvent injection port location.

15. The process of claim 1 wherein a solvent polarity gradient is controlled wholly or partly by a temperature gradient throughout the extraction column, achieved by feeding the heavy charge stock and solvents into the column at different temperatures.

16. The process of claim 2 wherein a solvent polarity gradient is controlled wholly or partly by a temperature gradient throughout the extraction column, achieved by feeding the heavy charge stock and solvents into the column at different temperatures.

17. The process of claim 1 wherein the column temperature and pressure are controlled such that at least one of the solvents exists as a supercritical fluid.

18. The process of claim 2 wherein the column temperature and pressure are controlled such that at least one of the solvents exists as a supercritical fluid.

19. The process of claim 1 wherein the boiling points of the solvents differ by at least 50° F.

20. The process of claim 2 wherein the boiling points of the solvents differ by at least 50° F.

21. The process of claim 1 wherein the internal design of the extraction column utilizes baffles and/or contacting devices.

22. The process of claim 2 wherein the internal design of the extraction column utilizes baffles and/or contacting devices.

* * * * *